US008835783B2

(12) United States Patent
Kiyono et al.

(10) Patent No.: US 8,835,783 B2
(45) Date of Patent: Sep. 16, 2014

(54) SWITCH AND METHOD FOR PRODUCING THE SAME

(75) Inventors: Yasuhiro Kiyono, Nagaokakyo (JP); Toshihiro Naruo, Kyoto (JP)

(73) Assignee: Omron Corporation, Kyoto (JP)

( * ) Notice: Subject to any disclaimer, the term of this patent is extended or adjusted under 35 U.S.C. 154(b) by 231 days.

(21) Appl. No.: 13/220,181

(22) Filed: Aug. 29, 2011

(65) Prior Publication Data

US 2012/0217143 A1 Aug. 30, 2012

(30) Foreign Application Priority Data

Oct. 14, 2010 (JP) ..... 2010-231111

(51) Int. Cl.

| | |
|---|---|
| ***H01H 9/02*** | (2006.01) |
| ***H01H 23/22*** | (2006.01) |
| *H01H 9/20* | (2006.01) |
| *H01H 23/20* | (2006.01) |

(52) U.S. Cl.

CPC ..... *H01H 9/0271* (2013.01); *H01H 9/20* (2013.01); *H01H 23/205* (2013.01); *H01H 23/22* (2013.01)

USPC ..... 200/293; 200/339; 200/557

(58) Field of Classification Search

CPC ..... H01H 23/205; H01H 23/20; H01H 9/02; H01H 9/0271

USPC ..... 200/553, 557, 339, 293

See application file for complete search history.

(56) References Cited

U.S. PATENT DOCUMENTS

| | | | | |
|---|---|---|---|---|
| 7,726,297 | B2 * | 6/2010 | Feisthammel et al. | 126/299 D |
| 2004/0263298 | A1 | 12/2004 | Feisthammel et al. | |

FOREIGN PATENT DOCUMENTS

| | | | |
|---|---|---|---|
| CN | 101645361 | A | 2/2010 |
| EP | 2151837 | A2 | 2/2010 |
| JP | 3047387 | U | 1/1998 |
| JP | 10172374 | A | 6/1998 |
| JP | 2000164076 | A | 6/2000 |
| JP | 3988323 | B2 | 1/2001 |
| JP | 2001014981 | A * | 1/2001 |

OTHER PUBLICATIONS

Extended European Search Report for European Application No. 11178048.2, Dated Nov. 24, 2011 (7 Pages).

Office Action issued in corresponding Chinese Application No. 201110229409.7 dated Nov. 20, 2013 (7 pages).

Notification of Reason for Rejection issued in counterpart Japanese application No. 2010-231111 mailed Apr. 22, 2014 (5 pages).

* cited by examiner

*Primary Examiner* — Felix O Figueroa

(74) *Attorney, Agent, or Firm* — Osha Liang LLP

(57) ABSTRACT

A switch has a manipulator that is supported by a housing and swung on one side and the other side, a power switch mechanism that brings contact portions of a movable piece and a fixed terminal into contact with each other when the manipulator is swung onto one side, the movable piece and the fixed terminal being disposed opposite each other in the housing, a returning spring that biases the manipulator in a swing manipulation direction when the manipulator is swung onto the other side, and a power retaining and releasing mechanism that includes a retaining portion and a releasing portion, the retaining portion regulating a restoring force of the returning spring according to the swing manipulation of the manipulator onto one side to retain a contact state of the contact portions of the movable piece and the fixed terminal.

13 Claims, 13 Drawing Sheets

SWITCH AND METHOD FOR PRODUCING THE SAME

BACKGROUND OF THE INVENTION

1. Technical Field

The present invention relates to a method for producing a switch used in, for example, a copying machine and a personal computer and, particularly to a switch having a shared use property and a method for producing the same.

2. Related Art

Generally, a switch provided with a reset mechanism is well known as a switch having a data protecting function. In the switch provided with the reset mechanism, for example, when a user manually manipulates a manipulator that is manipulated in a seesaw manner, contact portions that are disposed opposite each other so as to be able to be brought into contact with and separated from each other in the switch are brought into contact with each other to power on the switch. Then the manipulator is automatically be inverted by a reset signal output from a controller to turn off the power.

In the switch provided with the reset mechanism, a power switch mechanism and a power reset mechanism are incorporated in a housing. The power switch mechanism brings contact portions of a movable piece and a fixed terminal into contact with each other and separates the contact portions from each other to turn on and off the power. The power reset mechanism releases an on-retaining-state of the power using a solenoid.

Specifically, the single power reset mechanism and the two power switch mechanisms located on both sides of the power reset mechanism are disposed in parallel in the housing. Therefore, a space where the power reset mechanism and the power switch mechanisms are disposed in parallel in three rows is required in the housing, and a size of the switch is enlarged in a lateral direction (width direction) according to the number of parallel rows. A size in a longitudinal direction of the switch is also enlarged because a long movable piece is disposed in the housing such that turning of the movable piece can be performed to turn on and off the power.

As a result, currently there is a limitation to miniaturization of the switch, and the slimmer or further-miniaturized switch is hardly configured.

Moreover, this kind of switch is used as a power switch in the field in which a large current is opened and closed. However, at this point, welding is easily generated in the contact portions. Therefore, it is conceivable that a biasing force of a spring used to return the movable piece is enhanced to securely separate the contact portions from each other. However, when the biasing force of the spring is enhanced, unfortunately a manipulation feeling of the switch is degraded, and a lifetime of the switch is shortened because abrasion is accelerated in a switch mechanism portion subjected to the high biasing force of the spring.

Meanwhile, there has been proposed a switch provided with a reset mechanism in which the switch can be taken apart for the purpose of recovery, separated disposal, and recycle even if the contact portions of the power switch mechanism are welded (see Japanese Patent No. 3988323). In the switch provided with the reset mechanism, when the power reset mechanism is incorporated in the housing, an L-shaped fitting pawl of the power reset mechanism is detachably fitted in a hole portion made in a bottom surface of the concave housing.

However, in taking apart the switch provided with the reset mechanism, it is necessary to detach other components in order to open the concave inside of the housing. Therefore, it is a troublesome task. For example, it is necessary to detach the manipulator that is assembled so as to cover the upper surface of the housing therewith, and it is necessary that plural fitting pawls of the power reset mechanism fitted in the bottom surface of the housing be released in a narrow space. Therefore, considerable labor hours and many skilled persons are required to take apart and restore the switches.

Therefore, when the switch in which a conduction error is generated in the contact portion is detected in inspecting the switch, a sequence of troublesome restoring work (take apart→restore or component exchange→reassembly) is not performed from the viewpoint of production efficiency, but the switch in which the conduction error is generated is frequently discarded.

Additionally, a solenoid that is incorporated for the reset signal in the switch has various voltage specifications such as 5 V, 12 V, and 24 V according to the usage of the switch. Currently, the switch is produced while the voltage specification is fixed. Therefore, the voltage specification cannot be changed in the produced switch.

SUMMARY

One or more embodiments of the present invention provides a miniaturized, slim switch, in which effective components can be utilized without disposing all the components even if a conduction error is generated in a contact portion and a voltage specification can be changed in the produced switch, and a method for producing the switch.

In accordance with one aspect of the present invention, a method for producing a switch, the switch including: a manipulator that is supported by a housing and swung on one side and the other side; a power switch mechanism that brings contact portions of a movable piece and a fixed terminal into contact with each other when the manipulator is swung onto one side, the movable piece and the fixed terminal being disposed opposite each other in the housing; a returning spring that biases the manipulator in a swing manipulation direction when the manipulator is swung onto the other side; and a power retaining and releasing mechanism that includes a retaining portion and a releasing portion, the retaining portion regulating a restoring force of the returning spring according to the swing manipulation of the manipulator onto one side to retain a contact state of the contact portions of the movable piece and the fixed terminal, the releasing portion releasing the contact state retained by the retaining portion, wherein the switch is configured to be dividable, one side of the divided switch is treated as a housing body including a stacked attachment portion, the manipulator being mounted on the housing and the returning spring and the power retaining and releasing mechanism being attached on a lower side of the other side of the manipulator while stacked in the stacked attachment portion, the other side of the divided switch is treated as a power retaining and releasing mechanism portion including the returning spring and the power retaining and releasing mechanism, which are attached to the stacked attachment portion of the housing body, and the power retaining and releasing mechanism portion is detachably attached from a bottom of the stacked attachment portion of the housing body.

According to one or more embodiments of the present invention, because the power retaining and releasing mechanism portion can directly be attached and detached from the bottom of the housing body, it is not necessary to previously detach other components constituting the switch. Therefore, the power retaining and releasing mechanism portion can be attached and detached while the manipulator mounted on the housing body is attached.

Other components constituting the switch are attached and detached from the upper surface side of the housing body in which the upper surface is opened. On the other hand, the power retaining and releasing mechanism portion is attached and detached from the lower surface side of the housing body. Therefore, the disposition structure and the attaching and detaching manipulations, in which the power retaining and releasing mechanism portion does not interfere with other components, can be achieved, and it is not necessary to detach the manipulator.

The power retaining and releasing mechanism portion can be attached and detached while the returning spring and the power retaining and releasing mechanism are stacked. For example, the returning spring and the power retaining and releasing mechanism are vertically stacked and integrated like a rectangular solid, and therefore the simple shape can be formed. Accordingly, on the other hand of the housing body, a vertically long accommodation space may be provided on the stacked attachment portion side, a planar size of the switch is reduced as much as possible.

The vertical motion of the returning spring and the power retaining and releasing mechanism becomes the stacking direction, so that the operating direction and the disposition direction are aligned with each other to achieve the efficient, compact accommodation configuration.

Additionally, even after the switch is produced, the power retaining and releasing mechanism portion can be attached to and detached from the housing body, so that the power retaining and releasing mechanism portion can be replaced with another power retaining and releasing mechanism portion. For example, the power retaining and releasing mechanism portions having different voltage specifications such as 5 V, 12 V, and 24 V can be selected and replaced even after the switch is produced. That is, the switch widely used in various applications can be configured because the switch has a common function of being able to change the voltage specification.

In the method for producing a switch according to one aspect of the present invention, the power retaining and releasing mechanism portion may be attached while a center position and a height position of the stacked attachment portion are positioned by a positioning unit.

When the power retaining and releasing mechanism portion is attached to the stacked attachment portion in a switch assembling process, the positioning unit positions the power retaining and releasing mechanism portion in a predetermined given position by engaging the power retaining and releasing mechanism portion and the stacked attachment portion in a predetermined given position for the attachment. For example, the positioning can be achieved by the engagement of a projection and a recess.

In the method for producing a switch according to one or more embodiments of the present invention, the power retaining and releasing mechanism portion is naturally attached in a planar center position only by inserting the power retaining and releasing mechanism portion in the stacked attachment portion from the bottom of the stacked attachment portion. An insertion amount in the stacked attachment portion from the bottom is previously fixed, and the power retaining and releasing mechanism portion is fixed in the retaining manner at the position where the insertion thereof is completed, which allows the power retaining and releasing mechanism portion to be positioned in the height direction.

The power retaining and releasing mechanism portion in which the returning spring and the power retaining and releasing mechanism are integrated is independently treated. Therefore, the power retaining and releasing mechanism portion can simply be attached to the housing body only by inserting the power retaining and releasing mechanism portion from the bottom of the housing, and the assembling can efficiently be performed in a short time. Accordingly, switch assembling performance and the productivity of the switch are simultaneously improved.

In the method for producing a switch according to one aspect of the present invention, the switch may include a slide case that is attached to and detached from the stacked attachment portion in a sliding manner, the power retaining and releasing mechanism portion is integrally incorporated in the slide case, and the slide case is attached to and detached from the stacked attachment portion by sliding the slide case to the stacked attachment portion.

In the method for producing a switch according to one or more embodiments of the present invention, for example, the power retaining and releasing mechanism portion is used while incorporated in the slide case such as a rectangular-solid, so that the compact power retaining and releasing mechanism portion can efficiently be accommodated. The power retaining and releasing mechanism portion can simply be attached and detached by vertically sliding the power retaining and releasing mechanism portion along with the slide case from the bottom of the stacked attachment portion.

The plural switch components of the power retaining and releasing mechanism portion are collected and treated as one component, so that assembly and workability are improved. For example, during the switch producing process, one switch is divided into two components, namely, the housing body and the slide case, and the housing body and the slide case may previously be assembled. Therefore the assembled two components can previously be inspected.

That is, whether each of the housing body and the slide case is defective is checked before the switch is completely assembled, and the defective housing body or slide case can be removed before the switch is assembled when the defective component is detected. Therefore, generation of the defective product is reduced after the assembling of the switch is completed, and the good-workability, good-productivity switch can be produced.

In accordance with another aspect of the present invention, a switch includes: a manipulator that is supported by a housing and swung on one side and the other side; a power switch mechanism that brings contact portions of a movable piece and a fixed terminal into contact with each other when the manipulator is swung onto one side, the movable piece and the fixed terminal being disposed opposite each other in the housing; a returning spring that biases the manipulator in a swing manipulation direction when the manipulator is swung onto the other side; and a power retaining and releasing mechanism that includes a retaining portion and a releasing portion, the retaining portion regulating a restoring force of the returning spring according to the swing manipulation of the manipulator onto one side to retain a contact state of the contact portions of the movable piece and the fixed terminal, the releasing portion releasing the contact state retained by the retaining portion, wherein the switch includes a housing body and a power retaining and releasing mechanism portion, the housing body including a stacked attachment portion, the manipulator being mounted on the housing and the returning spring and the power retaining and releasing mechanism being attached on a lower side of the other side of the manipulator while stacked in the stacked attachment portion, and the power retaining and releasing mechanism portion including the returning spring and the power retaining and releasing mechanism, which are attached to the stacked attachment portion of the housing body, so that the power retaining and releasing mechanism portion is detachably attached from a bottom of the stacked attachment portion of the housing body.

According to one or more embodiments of the present invention, one switch is divided into two, and the switch can take two modes, namely, the integration state and the divided state. In dividing the switch, the power retaining and releasing mechanism portion is attached and detached from the bottom of the housing body, so that the power retaining and releasing mechanism portion can directly be attached to and detached from the housing body without interference with other component. Because the voltage specification of the power retaining and releasing mechanism portion can be changed, the switch can immediately be used in the filed by selecting the necessary voltage specification.

In the switch, when the manipulator is swung onto one side, because the power retaining and releasing mechanism is disposed on the swing manipulation side, the manipulator directly retains the retaining portion of the power retaining and releasing mechanism. Therefore, when the manipulator is swung onto one side, the swinging manipulation force is directly applied to the retaining portion, and the retaining portion can directly be manipulated.

Because the power switch mechanism and the power retaining and releasing mechanism are separately disposed on one side and the other side in the swing manipulation direction of the manipulator in the housing, the power switch mechanism and the power retaining and releasing mechanism are not concentrated in the central portion of the housing but disposed in the dispersed manner. Therefore, the slim switch in which the width direction of the housing is narrowed can be configured.

In the switch according to one aspect of the present invention, the stacked attachment portion may include a positioning unit that attaches the power retaining and releasing mechanism portion to the stacked attachment portion while a center position and a height position are positioned.

When the power retaining and releasing mechanism portion is attached to the stacked attachment portion, the positioning by the positioning unit can be achieved by engaging the power retaining and releasing mechanism portion and the stacked attachment portion in a given position. For example, the positioning can be achieved by the engagement of the projection and the recess.

According to the switch of one or more embodiments of the present invention, the power retaining and releasing mechanism portion is positioned and attached in the planar center position only by inserting the power retaining and releasing mechanism portion in the stacked attachment portion from the bottom of the stacked attachment portion. The positioning of the center position with respect to the opening of the stacked attachment portion can be achieved, and the correct connection and the electric conduction between the components can stably be secured. The insertion amount in the stacked attachment portion from the bottom is previously fixed, and the power retaining and releasing mechanism portion is fixed in the retaining manner at the position where the insertion thereof is completed, which allows the power retaining and releasing mechanism portion to be positioned in the height direction. At this point, because the bottom surface of the switch is aligned with the bottom surfaces of other components, there is no step in the outer shape of the switch, and therefore the appearance of the switch is not spoiled.

The power retaining and releasing mechanism portion in which the returning spring and the power retaining and releasing mechanism are integrated is independently treated. Therefore, the power retaining and releasing mechanism portion can simply be attached to the housing body only by inserting the power retaining and releasing mechanism portion from the bottom of the housing, and the assembling can efficiently be performed in a short time. Accordingly, the switch assembling performance and the productivity of the switch are simultaneously improved. In detaching the power retaining and releasing mechanism portion, the power retaining and releasing mechanism portion is put into the state in which the power reset unit can be drawn from the stacked attachment portion, and the power retaining and releasing mechanism portion is drawn directly downward from the bottom of the housing, which allows the power retaining and releasing mechanism portion to be simply detached without needing a skill.

In the switch according to another aspect of the present invention, the power retaining and releasing mechanism portion may be configured to be integrally incorporated in the slide case that attaches and detaches the returning spring and the power retaining and releasing mechanism to and from the stacked attachment portion in a sliding manner.

According to one or more embodiments of the present invention, the power retaining and releasing mechanism portion is used while incorporated in the slide case, so that the compact power retaining and releasing mechanism portion can be treated while the outer periphery is protected. The power retaining and releasing mechanism portion can simply be attached and detached by vertically sliding the stacked attachment portion along with the slide case. In this case, the power retaining and releasing mechanism portion is smoothly attached and detached because the outer peripheral surface of the slide case is guided while being in contact with the inner peripheral surface of the stacked attachment portion. Because the slide case has the independent, integral structure, a positioning portion can easily be formed in part of the outer peripheral surface of the slide case. Because the plural components are collected and treated as one component, assembly and workability are improved.

The switch according to another aspect of the present invention may further include a spring guide unit that is provided on an upper portion side of the slide case to guide the returning spring in a biasing direction.

The spring guide unit acts as the guide member of the vertically-elongated returning spring. For example, the spring guide unit includes an inner peripheral guide member that guides the inner peripheral surface of the returning spring or an outer peripheral guide member that guides the outer peripheral surface of the returning spring.

According to the switch of one or more embodiments of the present invention, the lower portion side of the returning spring is guided by the spring guide unit. Therefore, the returning spring can smoothly be guided in the returning spring biasing direction, and the upper portion of the returning spring can correctly aligned with the lower surface of the manipulator opposite to each other above the spring.

The switch according to another aspect of the present invention may further include a connector guide that is provided on a lower portion side of the slide case and connected to a terminal of the releasing portion.

In the switch of one or more embodiments of the present invention, the terminal of the releasing portion and an externally-connected connector can correctly be positioned and accurately be connected, and the terminal of the releasing portion and an externally-connected connector can be connected while the electric conduction is established. Therefore, the connection having high contact reliability can be secured in connecting the line to the external connector.

The switch having the above configuration can widely be used as a miniaturized switch in various electronic devices, such as a copying machine and a personal computer, which have controllers.

Accordingly, one or more embodiments of the present invention can provide a miniaturized, slim switch, in which effective components can be utilized without disposing all the components even if a conduction error is generated in a contact portion and a voltage specification can be changed in the produced switch, and a method for producing the switch.

DETAILED DESCRIPTION

Hereinafter, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

EMBODIMENTS

Figure 1A:
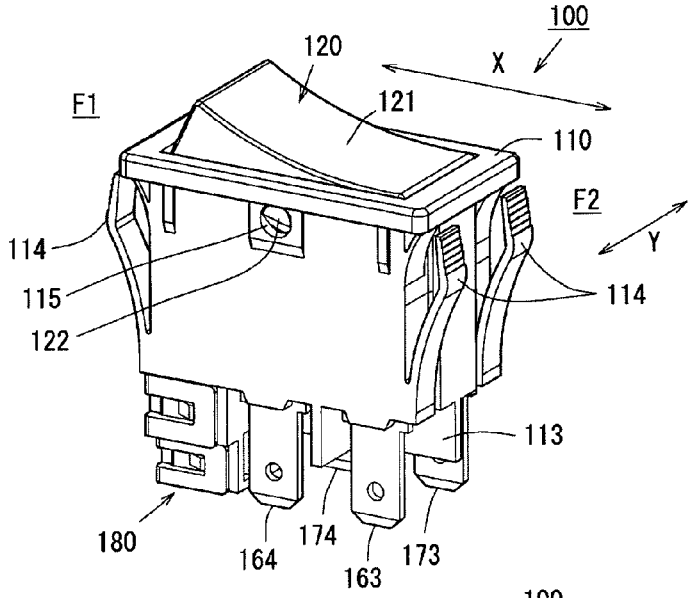
FIGS. 1A and 1B are perspective views illustrating an appearance of a switch.
Figure 1B:
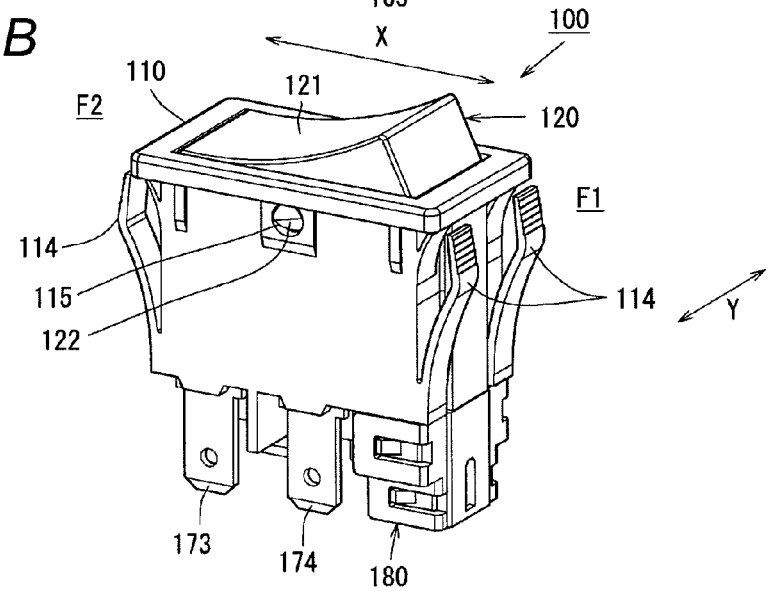
Figure 2:
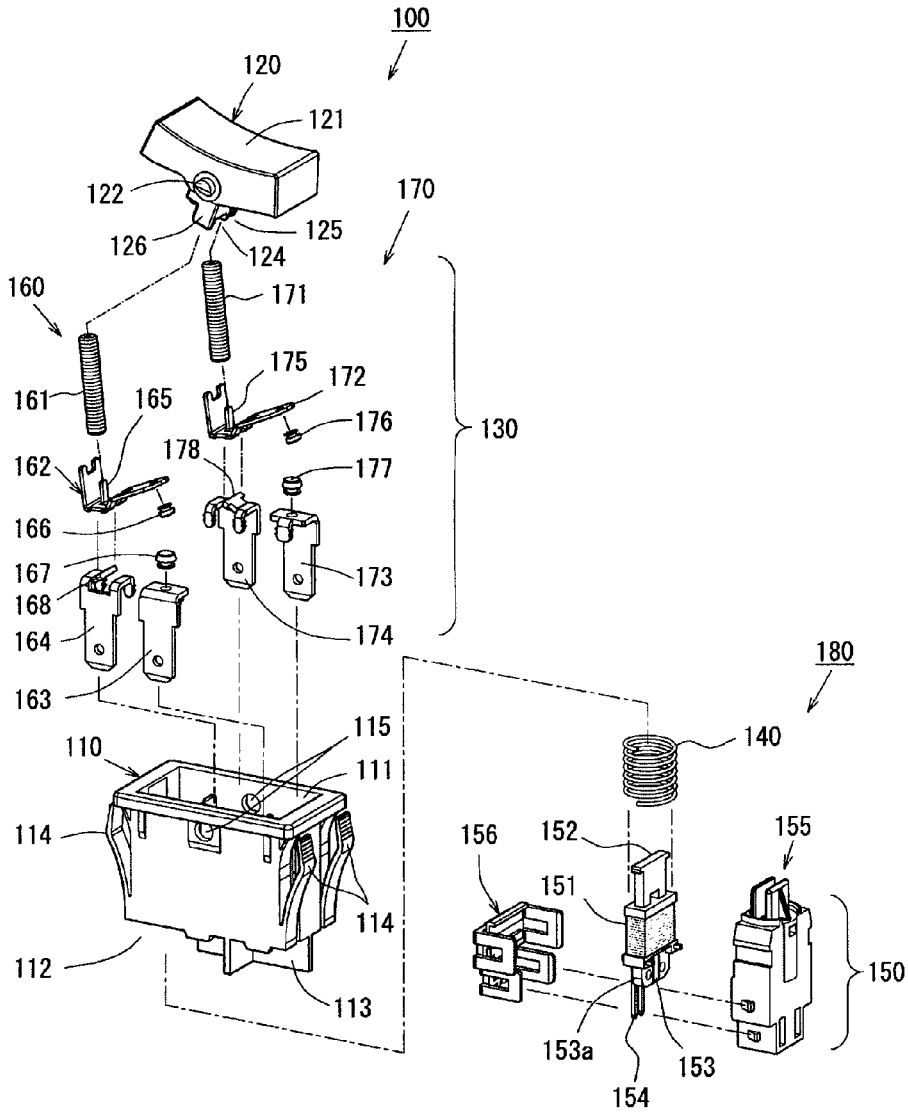
FIG. 2 is an exploded perspective view of the switch when the switch is viewed obliquely forward.
Figure 3:
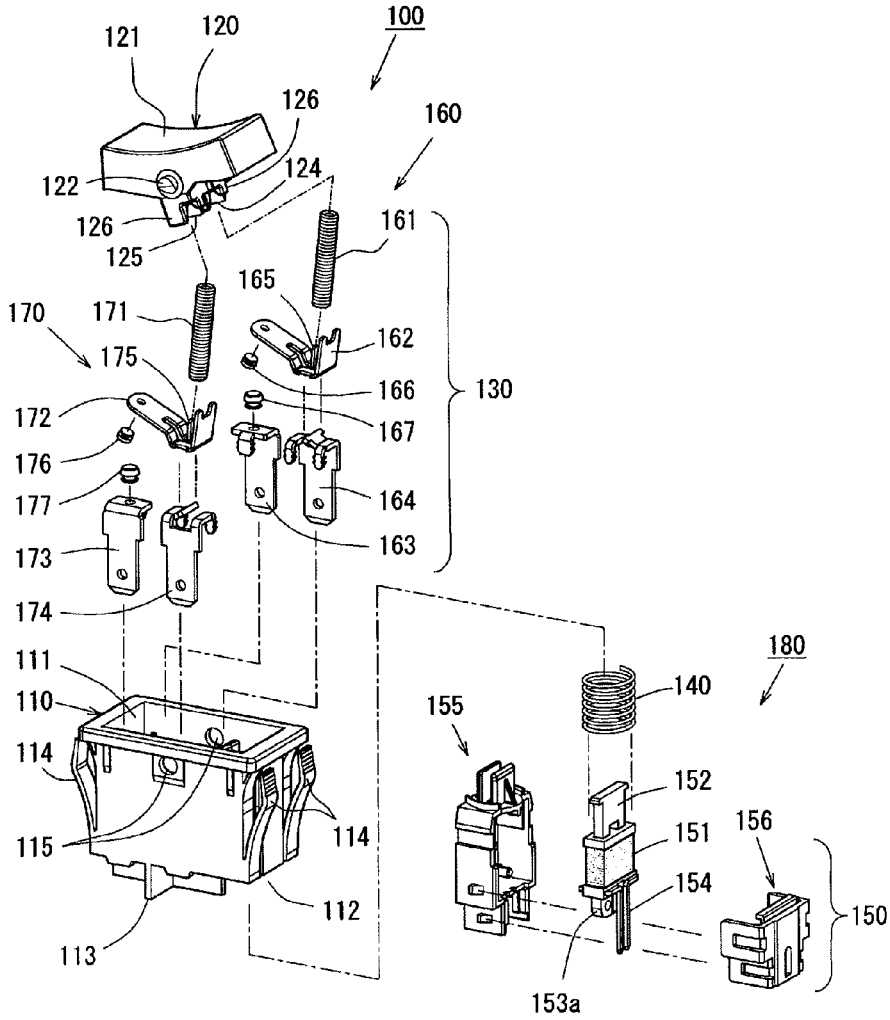
FIG. 3 is an exploded perspective view of the switch when the switch is viewed obliquely backward.

The drawings illustrate a switch provided with a reset function. FIG. 1A is a perspective view illustrating an appearance of a switch 100 when the switch 100 is viewed from one side, and FIG. 1B is a perspective view illustrating the appearance of the switch 100 when the switch 100 is viewed from the other side. FIG. 2 is an exploded perspective view of the switch 100 when the switch 100 is viewed from one side, and FIG. 3 is an exploded perspective view of the switch 100 when the switch 100 is viewed from the other side.

The switch 100 provided with the reset function is configured such that a manipulator 120, a power switch mechanism 130, a returning spring 140, and a power reset mechanism 150 are incorporated in a housing 110.

The housing 110 has a box shape in which an upper surface is opened. The housing 110 includes a recessed hollow portion 111 that is located on one side in a longitudinal direction X of the housing 110 and a stacked attachment portion 112 that is located on the other side in the longitudinal direction X. The power switch mechanism 130 is incorporated in the hollow portion 111. The returning spring 140 and the power reset mechanism 150 are attached from a bottom to the stacked attachment portion 112 while stacked.

The housing 110 includes a terminal partitioning portion 113 on the bottom side thereof, and the terminal partitioning portion 113 partitions two sets of terminals, namely, the total of four terminals that are vertically provided in parallel below the housing 110. After the power switch mechanism 130 is incorporated in the hollow portion 111 that is opened onto the upper side of the housing 110, the manipulator 120 is turnably attached to close the upper opening of the hollow portion 111 in a planar manner.

The housing 110 includes V-shaped elastic latch pieces 114 that are provided in both outer side surfaces in a width direction Y of the housing 110 and projected outward in order to fit the switch 100 in a device (not illustrated) in a retaining manner. The housing 110 includes pivot holes 115 that are made in central portions of wide outer side surfaces of the housing 110 in order to pivot the below described manipulator 120.

The manipulator 120 is formed into a box shape in which a bottom surface of a rectangular solid is opened. A press manipulation surface 121 is formed in an upper surface of the manipulator 120 and has a moderately concave shape suitable to press down the press manipulation surface 121 with a fingertip. Support shafts 122 are projected from both sides of the central portions of the outer side surfaces in the longitudinal direction X of the manipulator 120. The support shafts 122 are pivoted in the pivot holes 115 of the housing 110, and the manipulator 120 is turnably attached to the housing 110 in a seesaw manner with the pivot portions on both the sides as a turning fulcrum.

Thus, the manipulator 120 is swung in the longitudinal direction X while pivoted in the housing 110 in the seesaw manner, one side F1 in a direction in which the manipulator 120 is swung is set to a power-on side, and the other side F2 is set to a power-off side.

In the manipulator 120, a plunger 123 (see FIGS. 11A to 11C) projected downward is vertically provided on one side in an inner space in which a bottom surface is opened. An upper surface of an upwardly-biased movable magnetic piece 152 described later is pressed downward by a lower end portion of the plunger 123.

The manipulator 120 is used as a manipulation member that turns to perform an on/off operation of a power. The manipulator 120 includes a first switch manipulation portion 124, a second switch manipulation portion 125, and forced pressurization pieces 126, which are located on a lower surface of the manipulator 120.

The first switch manipulation portion 124 and the second switch manipulation portion 125 are formed on both sides of the lower surface while connecting the support shafts 122 on both the sides of the manipulator 120. The first switch manipulation portion 124 includes a circular hole that is used as an upper spring seat, and an upper portion of a first spring coupled body 161 provided in an upper portion of a first power switch mechanism 160 described later is fitted and retained in the circular hole. Meanwhile, the second switch manipulation portion 125 includes a circular hole that is used as an upper spring seat, and an upper portion of a second spring coupled body 171 provided in an upper portion of a second power switch mechanism 170 described later is fitted and retained in the circular hole.

Sidewalls on both sides of each of the first switch manipulation portion 124 and the second switch manipulation portion 125 are vertically provided while formed into vertically-long rectangular plates, thereby constituting the forced pressurization pieces 126. The forced pressurization pieces 126 are vertically provided as part of the manipulator 120 on both the sides in the center of the lower surface of the manipulator 120. Therefore, the forced pressurization pieces 126 turn along with the manipulator 120. As described later in FIGS. 13A to 13C, the manipulator 120 transmits a manipulation force of the manipulator 120 to which the off-operation is performed to movable pieces 162 and 172 of the power switch mechanism 130 to enable forced pressurization, and contact portions of the fixed terminals, which are located opposite the movable pieces 162 and 172, are forcedly separated from each other at that time.

Figure 4:
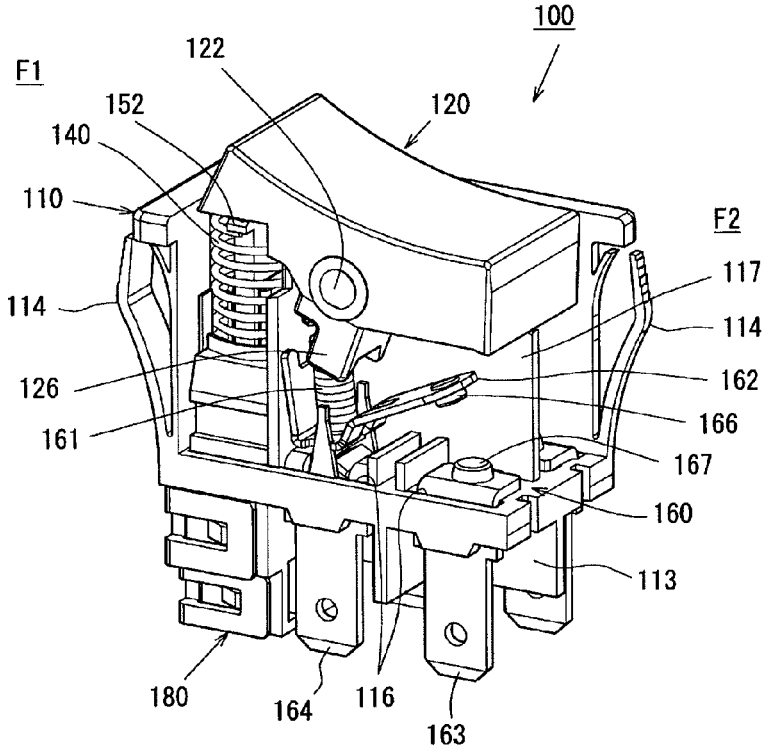
FIG. 4 is a partially sectional perspective view illustrating a main part of a power switch mechanism when the power switch mechanism is viewed forward.
Figure 5:
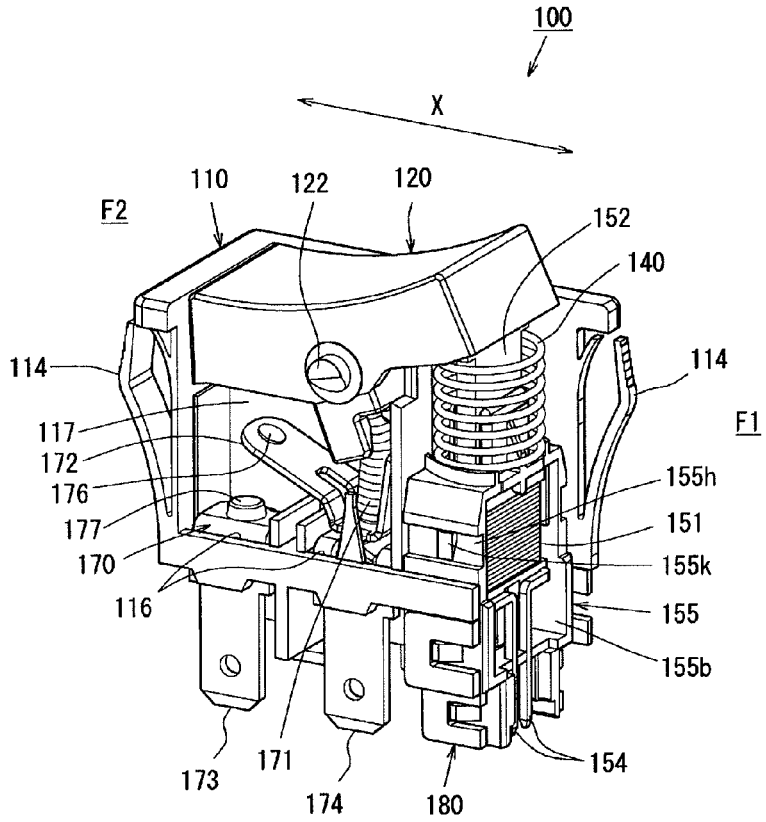
FIG. 5 is a partially sectional perspective view illustrating the main part of the power switch mechanism when the power switch mechanism is viewed backward.

FIG. 4 is a perspective view illustrating a main part of the first power switch mechanism 160 when the first power switch mechanism 160 is viewed from the side in assembled state of the exploded perspective view of FIG. 2. FIG. 5 is a perspective view illustrating a main part of the second power switch mechanism 170 when the second power switch mechanism 170 is viewed from the side in assembled state of the exploded perspective view of FIG. 3.

The power switch mechanism 130 includes a double switch configuration that corresponds to two circuits of the first power switch mechanism 160 and the second power switch mechanism 170, which are provided in parallel.

The first power switch mechanism 160 includes the first spring coupled body 161, the movable piece 162, a fixed terminal 163, and a common fixed terminal 164.

A small-diameter coil spring is used as the first spring coupled body 161. An upper end portion of the first spring coupled body 161 is coupled to the manipulator 120 while fitted in the first switch manipulation portion 124. A lower end portion of the first spring coupled body 161 is coupled to the below described movable piece 162 in the retaining manner by inserting and fitting an upwardly-projected fitting projection 165 of the movable piece 162 in a hole of the coil spring. The first spring coupled body 161 has a straight cylindrical shape in a free state before assembling. When being assembled, the first spring coupled body 161 is formed into a V-shape in which a central portion in an axial direction is slightly bent onto one side while the upper and lower end portions are supported.

The movable piece 162 is formed by bending a conductive metallic plate into an L-shape, and turnably supported by the below described common fixed terminal 164 with the L-shaped bent portion as the turning fulcrum. The fitting projection 165 is vertically cut out in an intermediate portion of the movable piece 162, and a conductive contact portion 166 is fixed to a leading end portion on an L-shaped horizontal piece side.

The fixed terminal 163 is formed by bending a conductive metallic plate into a reverse-L-shape, and a conductive contact portion 167 is fixed to an upper surface of the fixed terminal 163. The reverse-L-shaped vertical piece side of the fixed terminal 163 is inserted in a terminal attaching hole 116 of the housing 110, thereby attaching the fixed terminal 163 to the housing 110. At this point, the contact portion 167 is disposed upward in the bottom surface of the housing 110 to face the contact portion 166 of the movable piece 162 located above the contact portion 167.

Similarly the common fixed terminal 164 is formed by bending a conductive metallic plate into the reverse-L-shape, and a movable piece support portion 168 is formed by cutting out an upper surface of the common fixed terminal 164. The reverse-L-shaped vertical piece side of the common fixed terminal 164 is inserted in the terminal attaching hole 116 of the housing 110, thereby attaching the common fixed terminal 164 to the housing 110.

The first spring coupled body 161 vertically couples the V-shaped first switch manipulation portion 124 and the movable piece 162. When the manipulator 120 including the first switch manipulation portion 124 turns, one side F1 differs from the other side F2 in an orientation in an upper portion that supports the first spring coupled body 161 on a turning locus below the manipulator 120. Different angle differences are generated in one side F1 and the other side F2 on the turning locus, whereby the intermediate portion of the first spring coupled body 161 is reversed to provide a switch manipulation force to the movable piece 162 below the first spring coupled body 161.

The use of the first spring coupled body 161 easily exerts rich elasticity, a flexible bending property in not only the axial direction but also a crosswise direction, and an elastic deformation necessary to repeatedly perform the turn-on and -off operations like the switch. Accordingly, the use of the first spring coupled body 161 that is rich in flexibility to be able to follow the turning of the manipulator 120 can easily follow the angle difference on the turning locus to smoothly turn the movable piece 162 below the first spring coupled body 161 in an on-direction and an off-direction.

The second power switch mechanism 170 is disposed while having the same configuration as the first power switch mechanism 160. The first power switch mechanism 160 and the second power switch mechanism 170 are disposed in parallel positions so as to simultaneously receive the manipulation force of the one manipulator 120. Therefore, the second power switch mechanism 170 has the same function as the first power switch mechanism 160 to simultaneously perform the on- and off-manipulations.

For this reason, in the second power switch mechanism 170, the same components as those of the first power switch mechanism 160 are disposed. Therefore, the description of the second power switch mechanism 170 is omitted because the second power switch mechanism 170 includes the first spring coupled body 171, the movable piece 172, the fixed terminal 173, the common fixed terminal 174, the fitting projection 175, and the contact portions 176 and 177, which are identical to those of the first power switch mechanism 160 described above.

As illustrated in FIGS. 4 and 5 as well, the first power switch mechanism 160 and the second power switch mechanism 170 are partitioned by a first partition plate 117 in the housing 110. Therefore, each of the power switch mechanisms 160 and 170 ensures one switch manipulation space that is partitioned by an inner wall of the housing 110 and the partition plate 117.

Figure 11A:
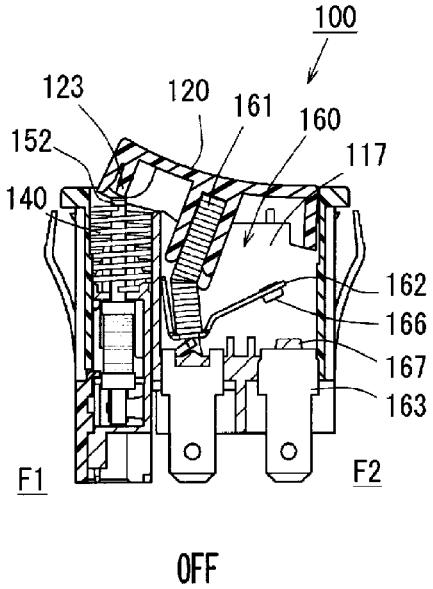
FIGS. 11A, 11B, and 11C are vertical sectional views illustrating on-operation and off-operation states of the switch.
Figure 11B:
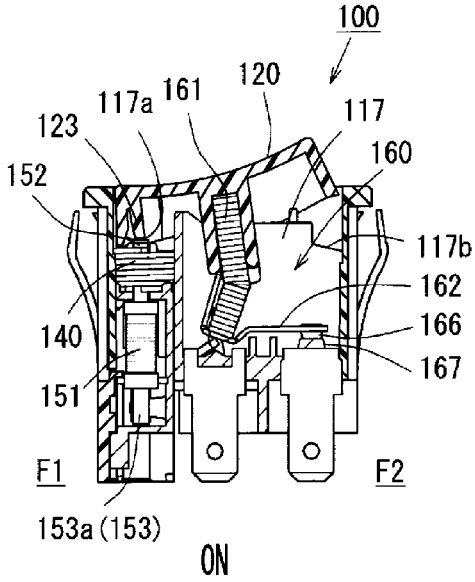

The upper surface of the partition plate 117 constitutes a stopper surface that regulates the turning on one side F1 and the other side F2 of the manipulator 120, and an on-stopper surface 117*a* is obliquely formed in the upper surface of the partition plate 117 that faces one side of the manipulator 120 as illustrated in FIG. 11B. An off-stopper surface 117*b* is obliquely formed in the upper surface of the partition plate 117 that faces the other side of the manipulator 120.

Figure 6:
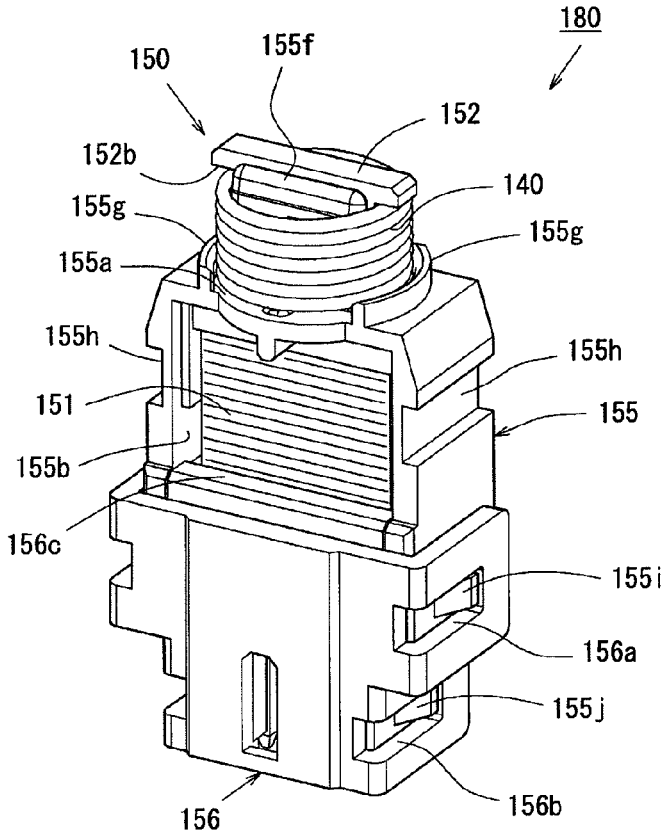
FIG. 6 is a perspective view illustrating an appearance of a power reset unit.
Figure 7:
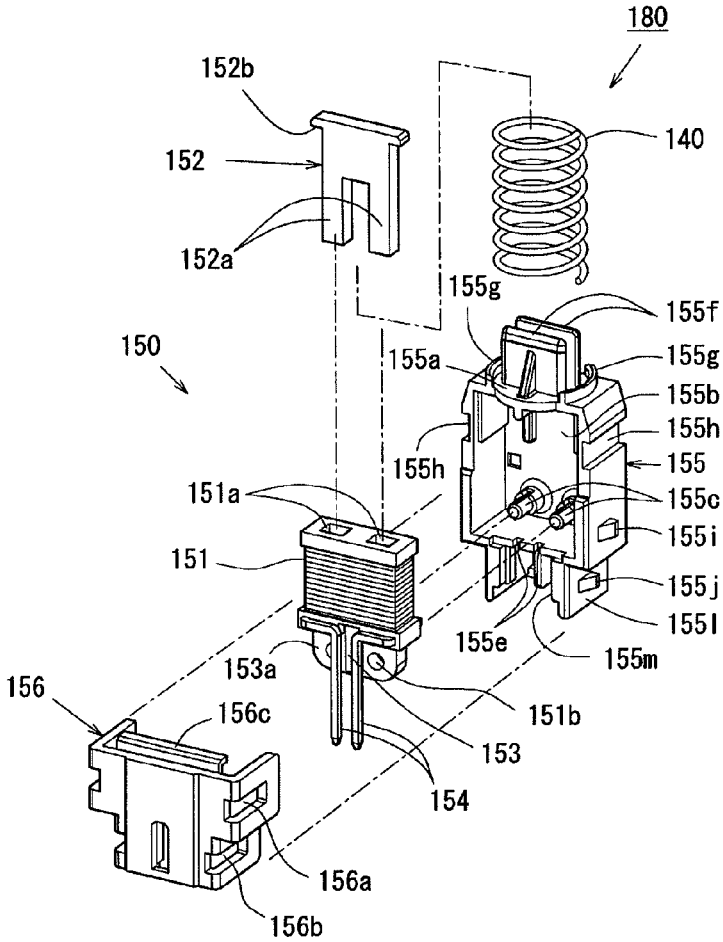
FIG. 7 is an exploded perspective view of the power reset unit.
Figure 8:
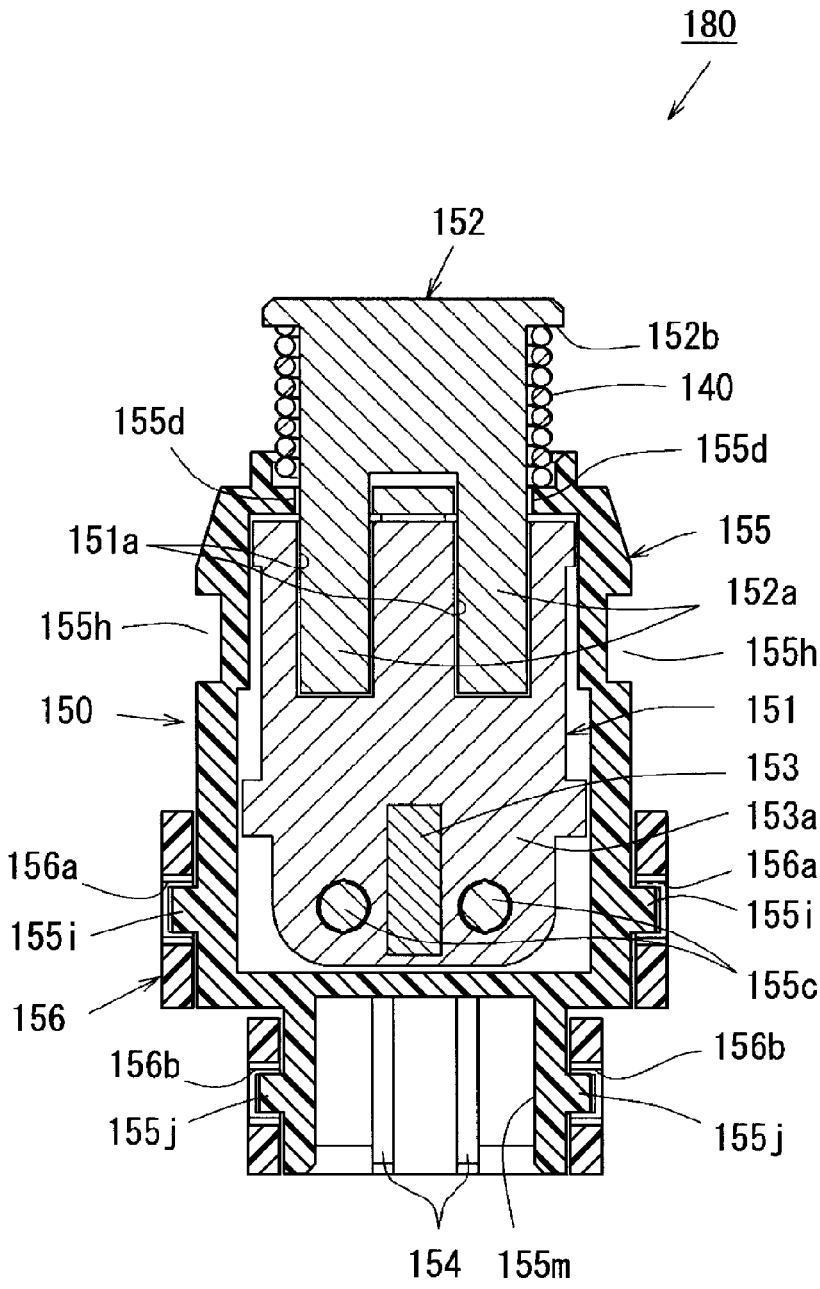
FIG. 8 is a vertical sectional view of the power reset unit.

FIG. 6 is a perspective view illustrating a power reset unit 180 in which the returning spring 140 and the power reset mechanism 150 are integrally assembled, FIG. 7 is an exploded perspective view illustrating the power reset unit 180, and FIG. 8 is a vertical sectional view illustrating a main part of the power reset unit 180.

The power reset unit 180 is one in which the returning spring 140 and the power reset mechanism 150 are integrally assembled. Therefore, the power reset unit 180 can independently be treated by previously assembling the returning spring 140 and the power reset mechanism 150. For this reason, plural components of FIG. 7 are previously integrated as illustrated in FIG. 6. Accordingly, the assembling can efficiently be performed in a short time in attaching the power reset unit 180 to the housing 110.

In attaching the power reset unit 180 to the housing 110, the power reset unit 180 can be attached from the bottom of the housing 110. Therefore, the power reset unit 180 can directly be attached to the housing 110 without interference with other components, thereby achieving the efficient assembling.

Because only the power reset unit 180 may be inserted from the bottom of the housing 110, not only the simple attachment can be achieved, but also the power reset unit 180 can easily be detached by downwardly drawing the power reset unit 180 even after the attachment is completed. Thus, the switch 100 has the configuration in which the one switch 100 is treated while divided into the side of the housing 110 and the side of the power reset unit 180.

The detailed configuration of the power reset unit 180 will be described below.

The returning spring 140 incorporated in the power reset unit 180 includes the coil spring. The returning spring 140 is vertically interposed between a movable magnetic piece 152 and a solenoid 151 of the below described power reset mechanism 150. As illustrated in FIG. 11A, the returning spring 140 is generally in a standby state, in which the returning spring 140 is elongated to push up the manipulator 120 with the movable magnetic piece 152 interposed therebetween, thereby turning the manipulator 120 in the off-direction.

Similarly the power reset mechanism 150 incorporated in the power reset unit 180 includes the solenoid 151, the movable magnetic piece 152, a permanent magnet 153, a fixed magnetic piece (yoke) 153*a*, a reset-signal input terminal 154, and a slide case 155, and a lower cover 156. The slide case 155 accommodates and supports the solenoid 151, the movable magnetic piece 152, the permanent magnet 153, the fixed magnetic piece 153*a*, and the reset-signal input terminal 154.

In the solenoid 151, a coil is wound around a plate-like outer peripheral surface. A left-and-right pair of insertion portions 151*a* that are vertically opened is provided in the upper surface of the solenoid 151. Leg portions 152*a* of the below described movable magnetic piece 152 can vertically be inserted in the insertion portions 151*a*. The permanent magnet 153, the fixed magnetic piece 153*a*, and the reset-signal input terminal 154 are disposed opposite an inner end portion side of the inserted movable magnetic piece 152. Horizontally-pierced engagement holes 151*b* are made in the lower portion of the solenoid 151 in order to attach the slide case 155.

The movable magnetic piece 152 having a T-shape includes the two vertically-provided leg portions 152*a* that are located in the lower portion thereof, and the leg portions 152*a* are provided so as to be insertable in the insertion portions 151*a* of the solenoid 151.

In the movable magnetic piece 152, a lower surface of a step portion extending to both sides in the T-shape constitutes an upper spring seat 152*b* of the returning spring 140. The upper surface of the slide case 155 constitutes a lower spring seat 155*a*, and the returning spring 140 is stretchably retained between the upper and lower spring seats 152*b* and 155*a*. As illustrated in FIGS. 4 and 5, in the standby state of the switch, usually the returning spring 140 is elongated to push up one side of the manipulator 120.

When the manipulator 120 is turned on, the plunger 123 in the lower surface of the manipulator 120 presses the upper portion of the movable magnetic piece 152 down, and the movable magnetic piece 152 moves downward against a biasing force of the returning spring 140. Then, when the leg portions of the movable magnetic piece 152 reach a lower end, the movable magnetic piece 152 is attracted and retained on the lower side by the rectangular-solid permanent magnet 153 that faces the movable magnetic piece 152 and the U-shaped fixed magnetic pieces 153*a* that are disposed across the permanent magnet 153 from each other. In the attracted and retained state, as illustrated in FIGS. 6 and 8, the returning spring 140 is retained while vertically compressed. A power-on state is maintained by the attracting and retaining action. When magnetic releasing action is externally provided to the solenoid 151 through the reset-signal input terminal 154 in the power-on state, the attracting and retaining action is released to turn off the power (releasing function).

As illustrated in FIG. 7, the slide case 155 having the box shape is provided while one side surface is opened, and the solenoid 151 in a standing posture is accommodated in an opened inner space 155*b*. Solenoid attachment pins 155*c* are projected in parallel in a lower portion of a deep wall surface of the inner space 155*b*, and the solenoid attachment pins 155*c* are horizontally inserted in the horizontally-pierced engagement holes 151*b* below the solenoid 151 in attaching the solenoid 151, thereby correctly positioning and attaching the solenoid 151 in the inner space 155*b*.

As illustrated in FIG. 8, a left-and-right pair of top-panel insertion holes 155*d* in which the leg portions 152*a* of the movable magnetic piece 152 are inserted is made in a top panel constituting the inner space 155*b*. Therefore, the movable magnetic piece 152 is supported in a vertically movable manner. A left-and-right pair of vertically-notched terminal fitting grooves 155*e* is provided in a front end surface of a bottom panel constituting the inner space 155*b*.

An inner peripheral spring guide portion 155*f* and an outer peripheral spring guide portion 155*g* are provided in the upper portion of the slide case 155 in order to enhance guide performance at the lower spring seat 155*a* of the returning spring 140.

Stand-up panel is formed in the inner peripheral spring guide portion 155*f*. The stand-up panel is smaller than an inner diameter of the returning spring 140 in the central portion of the upper surface of the slide case 155, and the stand-up panel is vertically provided in order to be able to vertically guide an inner peripheral surface of the returning spring 140. The stand-up panels are disposed in parallel while striding across the top-panel insertion holes 155*d* in the longitudinal direction X (see FIG. 5).

That is, in the inner peripheral spring guide portion 155*f*, the outsides of the stand-up panels have a function of guiding the inner peripheral side of the returning spring 140, and the movable magnetic piece 152 is vertically guided between surfaces facing each other in the stand-up panels that are disposed in parallel. Therefore, the inner peripheral spring guide portion 155*f* can guide the returning spring 140 and the movable magnetic piece 152, which are vertically moved.

In the upper surface of the slide case 155, the outer peripheral spring guide portions 155*g* are formed on both sides of the inner peripheral spring guide portions 155*f* by vertically providing arc shapes having given lengths along the outer peripheral surface of the returning spring 140. Therefore, the outer peripheral spring guide portions 155*g* can vertically guide the returning spring 140 along the outer peripheral surface of the returning spring 140.

A retaining groove 155*h*, an upper latch projection 155*i*, and a lower latch projection 155*j* are sequentially provided from the top to the bottom in each of the side surfaces of the slide case 155.

The retaining groove 155*h* is fixed to the inside of the below-described stacked attachment portion 112 in the retaining manner when the slide case 155 is attached to the stacked attachment portion 112.

Figure 9:
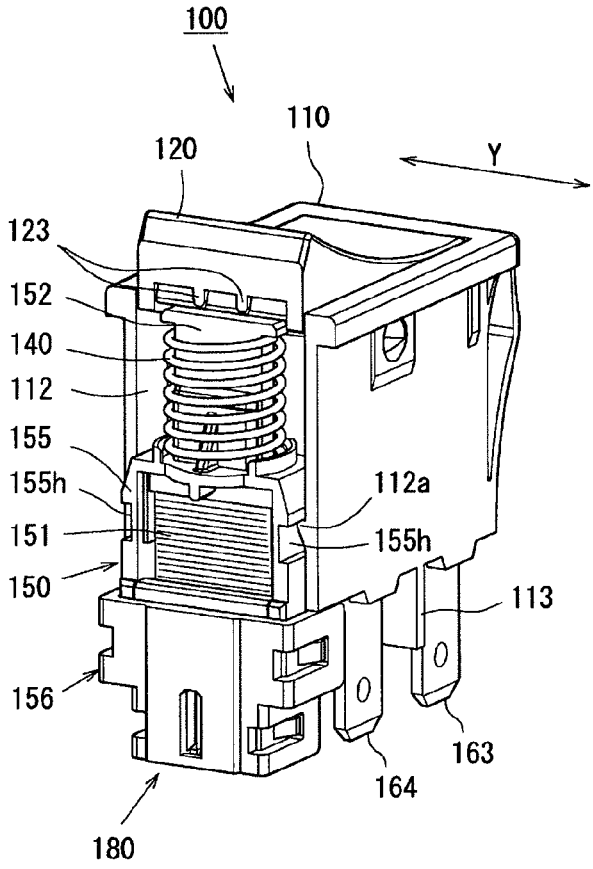
FIG. 9 is a perspective view illustrating a correspondence relationship between the power reset unit and a manipulator.

The stacked attachment portion 112 having a rectangle shape in plan view is a vertically long space. The stacked attachment portion 112 is vertically pierced by opening the bottom of one side F1 in the recess of the housing 110. As illustrated in FIG. 9, a retaining projection 112*a* corresponding to the retaining groove 155*h* is provided in each of the inner wall surfaces of the vertically long space.

When the power reset unit 180 is attached by pushing and sliding the power reset unit 180 from the bottom of the stacked attachment portion 112, the retaining grooves 155*h* on both the sides of the slide case 155 of the power reset unit 180 are engaged in a position, where the attachment of the power reset unit 180 is completed after the sliding, while corresponding to the retaining projections 112*a* that are projected from the inner wall surfaces on both the sides in the width direction Y of the stacked attachment portion 112. Therefore, the power reset unit 180 is fixed and attached to the stacked attachment portion 112.

At this point, in the stacked attachment portion 112, the power reset unit 180 is incorporated in the stacked attachment portion 112 while a center position and a height position of the power reset unit 180 are positioned with respect to the stacked attachment portion 112.

As to the positioning, an accommodation space of the stacked attachment portion 112 having a square shape in section is provided such that side surfaces of the box-shaped slide case 155 are slid and guided vertically from front to back and from side to side, and the slide case 155 is correctly positioned in front-back direction to guide the power reset unit 180 to the planar center position, which allow the power reset unit 180 to be attached to the stacked attachment portion 112.

As to the retaining groove 155*h*, as illustrated in FIG. 5, a narrow positioning projection 155*k* is formed in the groove of the retaining groove 155*h* on one side, and the retaining projection 112*a* corresponds to the end surface in the longitudinal direction X of the positioning projection 155*k*, which allows the positioning accuracy to be further enhanced in the longitudinal direction X.

When the power reset unit 180 is attached to the stacked attachment portion 112, the retaining groove 155*h* and the retaining projection 112*a* are positioned such that the power reset unit 180 is fixed to the constant position where the sliding of the power reset unit 180 is completed, which allows the power reset unit 180 to be correctly positioned in the vertical direction. That is, an insertion amount of the power reset unit 180 in the stacked attachment portion 112 from the bottom is fixed, and the power reset unit 180 is fixed to the stacked attachment portion 112 in the retaining manner such that the groove and the projection are engaged at the position where the power reset unit 180 is inserted in the stacked attachment portion 112, which allows the power reset unit 180 to be positioned in the height direction.

The upper latch projection 155*i* and the lower latch projection 155*j* are vertically provided and projected from each of the side surfaces of the slide case 155, and have a function of engaging and coupling a lower cover 156 described below. The upper latch projection 155*i* is projected from each of the side surfaces in the lower portion of the slide case 155. On the other hand, the lower latch projection 155*j* is projected from each of the side surfaces of a U-shaped connector guide case 155*l*. The connector guide case 155*l* is smaller than the slide case 155 and vertically provided in the lower portion of the slide case 155.

A connector coupling portion 155*m* connected to the reset-signal input terminal 154 is formed in the inner surface of the U-shaped connector guide case 155*l*. The reset-signal input terminal 154 and an externally-connected connector (not illustrated) can correctly be positioned and accurately be connected in combination with the lower cover 156, and the electric conduction can securely be established between the reset-signal input terminal 154 and the externally-connected connector. Therefore, the connection having high contact reliability can be secured in connecting the line to the external connector.

The lower cover 156 is formed larger than the lower width of the slide case 155, and the lower cover 156 is formed into a two-stage U-shape in plan view having a larger U-shape and a smaller U-shape vertically provided. The upper wide U-shape includes an upper engagement groove 156*a* corresponding to the upper latch projection 155*i*, and the lower narrow U-shape includes a lower engagement groove 156*b* corresponding to the lower latch projection 155*j*.

When the lower cover 156 engages the slide case 155 such that the lower opened side of the slide case 155 is covered therewith, the upper engagement groove 156*a* engages the upper latch projection 155*i*, and the lower engagement groove 156*b* engages the lower latch projection 155*j*, whereby the lower cover 156 is integrally coupled to the lower portion of the slide case 155. Therefore, a connection space 155*n* for the connector coupling guide is formed, and the connection space 155*n* has a rectangular shape in plan view (see FIGS. 10A and 10B).

A front surface of the lower cover 156 includes a terminal protective plate 156*c*. When the lower cover 156 is attached to the slide case 155, the terminal protective plate 156*c* protects an exposed portion of the reset-signal input terminal 154 by covering the exposed portion therewith.

Figure 10A:
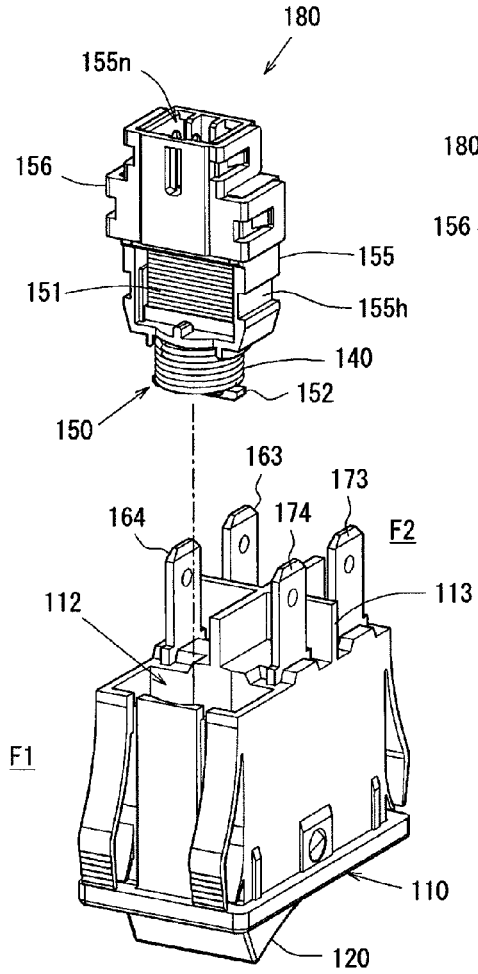
FIGS. 10A and 10B are perspective views illustrating attachment and detachment states of the power reset unit.
Figure 10B:
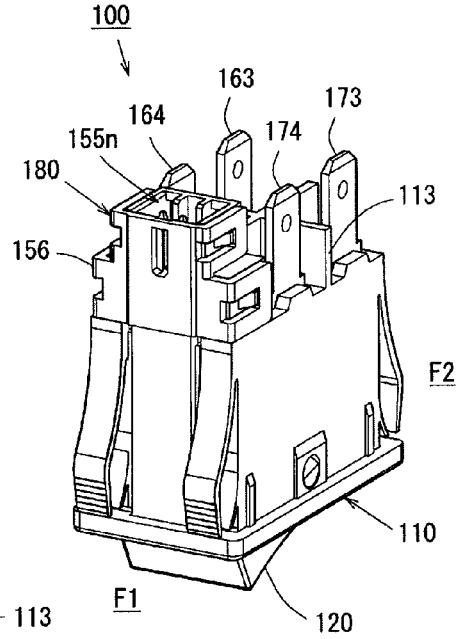

FIG. 9 is a partially sectional perspective view illustrating an internal state in which the power reset unit 180 is incorporated in the housing 110, FIG. 10A is a perspective view illustrating a state before the power reset unit 180 is attached, and FIG. 10B is a perspective view illustrating a state after the power reset unit 180 is attached.

As illustrated in FIG. 10A, the housing 110 in which the power reset unit 180 is incorporated includes the stacked attachment portion 112 serving as the accommodation space on one side F1. Although the power reset unit 180 is attached to and detached from the stacked attachment portion 112 of the housing 110, because the shape of the stacked attachment portion 112 is identical to the shape of the power reset unit 180, the power reset unit 180 can commonly be used. Accordingly, the power reset unit 180 having a different voltage specification (described later) can selectively be changed.

The switches 100 before and after the power reset unit 180 is attached differ from each other only in the existence or non-existence of the power reset unit 180, and the switches 100 before and after the power reset unit 180 is attached include the manipulator 120 and the power switch mechanism 130. Therefore, one side of the switch 100 configured to be dividable into two parts is collectively referred to as a housing 110, and the other side is referred to as a power reset unit 180.

In the switch 100, it is assumed that an upper side is the side on which the manipulator 120 is mounted on the housing 110, and it is assumed that a lower side is the lower surface side of the housing 110 on the other side of the upper side. Accordingly, as illustrated in FIGS. 10A and 10B, the upper side and the lower side of the switch 100 are not changed even if the switch 100 and the housing 110 are turned upside down.

When the power reset unit 180 thus configured is incorporated in the housing 110, as illustrated in FIG. 10A, the power reset unit 180 is inserted in the housing 110 from the bottom of the stacked attachment portion 112 that is the vertically long space opened onto one side and has a rectangle shape in plan view.

At this point, the power reset unit 180 is fixed to the stacked attachment portion 112 in the retaining manner at the time the retaining groove 155*h* of the power reset unit 180 engages the retaining projection 112*a* of the stacked attachment portion 112.

The power reset unit 180 can easily be attached only by vertically sliding the whole of power reset unit 180. The power reset unit 180 is smoothly attached and detached because the outer peripheral surface of the slide case 155 is guided while being in contact with the inner peripheral surface of the stacked attachment portion 112. Because the power reset unit 180 has the independent, integral structure, a positioning portion can easily be formed in part of the outer peripheral surface of the power reset unit 180. Because the plural components are collected and treated as one component, assembly and workability are improved.

The power reset unit 180 is positioned and attached to the planar center position at the time the power reset unit 180 is attached, so that the correct connection and electric conduction between the components can stably be secured. Because the power reset unit 180 is fixed in the retaining manner at the position where the insertion of the power reset unit 180 is completed, the power reset unit 180 can also be positioned in the height direction. At this point, because the bottom surface of the switch is aligned with the bottom surfaces of other components, there is no step in the outer shape of the switch. Therefore, the switch is formed into the rectangular solid, but the appearance of the switch is not spoiled.

In particular, the power reset unit 180 can be attached to and detached from the bottom of the housing 110, it is not necessary to previously detach another component constituting the switch. Therefore, the power reset unit 180 can be attached or detached while the manipulator 120 remains mounted on the housing 110.

Because the power reset unit 180 can be detached from the bottom of the housing 110 without interference with other components, when the voltage specification of the power reset unit 180 is desired to be changed to 5 V, 12 V, or 24 V, the voltage specification can appropriately be selected. Therefore, the switch 100 can immediately be used in the filed by selecting the necessary voltage specification.

Figure 11C:
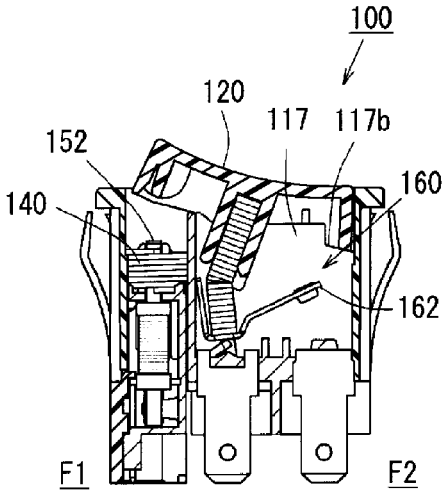

FIG. 11A illustrates an off-state of the first power switch mechanism 160 when the switch 100 is viewed from one side surface, FIG. 11B illustrates an on-state of the first power switch mechanism 160 when the switch 100 is viewed from one side surface, and FIG. 11C illustrates a state in which the solenoid 151 is turned on while only the manipulator 120 is turned off.

As illustrated in FIG. 11A, in the case that the first power switch mechanism 160 is in the off state, usually the returning spring 140 is elongated, the upper end portion of the movable magnetic piece 152 biased by the returning spring 140 pushes up the manipulator 120 via the plunger 123, and the manipulator 120 is biased and supported to the off-position. At this point, the manipulator 120 is in the state in which the manipulator 120 turns in the off-direction. In the off-state, the first spring coupled body 161 is curved in the power-off direction, the L-shaped movable piece 162 turns in the off-direction with the bent portion as the turning fulcrum, the contact portion 166 of the movable piece 162 is separated from the contact portion 167 of the fixed terminal 163.

When the on-manipulation is performed to the switch 100 thus configured, as illustrated in FIG. 11B, the manipulator 120 is pressed in the on-direction, and the plunger 123 of the manipulator 120 pushes down the movable magnetic piece 152 against the biasing force of the returning spring 140.

Therefore, the movable magnetic piece 152 moves downward to be inserted in the insertion portion 151*a* of the solenoid 151, and the movable magnetic piece 152 is attracted by the magnetic attraction action of the permanent magnet 153 and the fixed magnetic piece 153*a*, which are located below the solenoid 151. At this point, the returning spring 140 is compressed, and the on-state is retained by the magnetic attraction action while the returning spring 140 is compressed.

When the on-manipulation is performed to the manipulator 120, the central portion in the axial direction of the first spring coupled body 161 of the first power switch mechanism 160 is reversely warped, and the movable piece 162 turns by a reaction force of the central portion to bring the contact portions 166 and 167 into contact with each other to turn on the power.

When the switch 100 is turned off, the manipulator 120 is pressed down in the off-direction as illustrated in FIG. 11C. At this point, the manipulator 120 turns in the off-direction to turn off the power. Then the switch 100 waits for the reset signal from a controller. When the reset signal is received, the returning spring 140 that is regulated in the compressed state is elongated, the first power switch mechanism 160 returns to the power-off state by receiving a restoring force of the elongated returning spring 140 as illustrated in FIG. 11A.

The second power switch mechanism 170 is operated similarly to the first power switch mechanism 160, and the on-manipulation is performed to the second power switch mechanism 170 in synchronization with the first power switch mechanism 160.

The power-on state is maintained until the reset signal is input to the solenoid 151 from the controller.

With the switch thus configured, in the housing 110, the power reset mechanism 150 is disposed on the on-side that is one side F1 in the swing manipulation direction of the manipulator 120. On the other hand, the first power switch mechanism 160 is disposed on the off-side that is the other side F2 in the swing manipulation direction of the manipulator 120. When the manipulator 120 is manipulated to the on-side, the movable magnetic piece 152 is attracted and retained to be locked in the solenoid 151 of the power reset mechanism 150 by the manipulation direction of the manipulator 120. Because the on-manipulation force of the manipulator 120 is directly applied to the power reset mechanism 150, a relay member for transmitting the manipulation force can be eliminated.

The first power switch mechanism 160 and the power reset mechanism 150 are separately disposed on the on-side and the off-side of the manipulator 120 in the housing 110, namely, one side F1 and the other side F2 in the swing manipulation direction of the manipulator 120, so that the first power switch mechanism 160 and the power reset mechanism 150 are not concentrated in the central portion of the housing 110 but disposed in the dispersed manner. Therefore, the slim switch 100 in which the width direction of the housing 110 is narrowed can be configured.

In the power reset mechanism 150, because the components can be stacked, the planar disposition space can be reduced when the power reset mechanism 150 is viewed from the stacking direction. Therefore, the compact disposition can be achieved with a small occupied area of the power reset mechanism 150, and the switch can securely be miniaturized.

In the power switch mechanism 130, because the movable pieces 162 and 172 are disposed while bent into the L-shape, the movable pieces 162 and 172 in which the turning fulcrum is located near the bend portion have the turning locus of the substantial radius length, and the turning occupied space of the movable piece can be reduced. Therefore, the movable piece itself is compactly incorporated in the housing to reduce the size of housing 110, so that the switch can further be miniaturized.

Figure 12A:
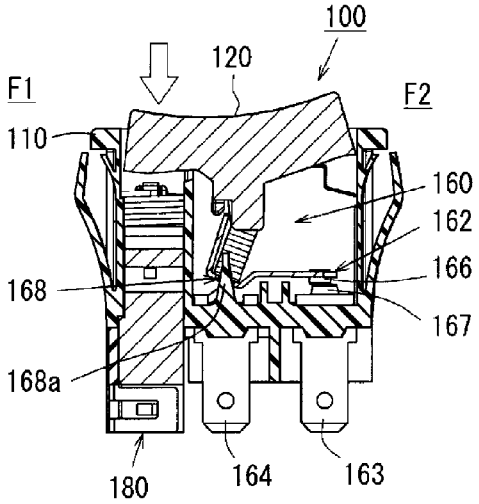
FIGS. 12A, 12B, and 12C are sectional explanatory views of the switch, illustrating a wiping operation of a movable piece.
Figure 12B:
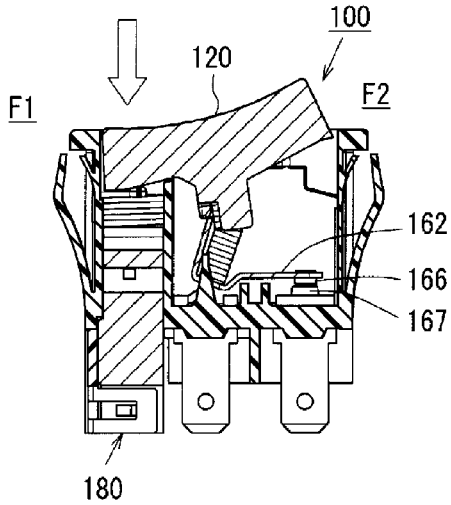
Figure 12C:
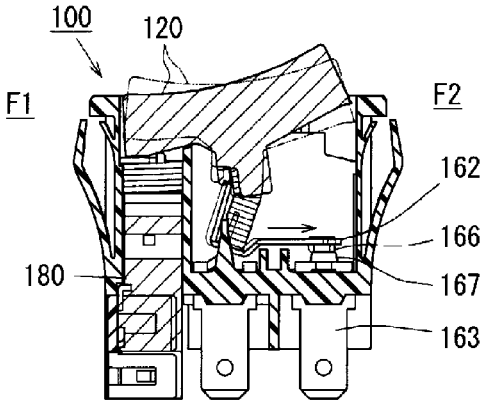

FIGS. 12A to 12C each illustrate an example of a wiping processing operation of the first power switch mechanism 160. FIG. 12A is a vertical sectional view illustrating the switch of an initial contact state between the movable piece and the contact portion of the fixed terminal before wiping, FIG. 12B is a vertical sectional view illustrating the switch of a contact state between the movable piece and the contact portion of the fixed terminal after the wiping, and FIG. 12C is a vertical sectional view illustrating the switch after sliding movement of the movable piece.

In the initial contact (see FIG. 12A) in which the contact portion 166 of the movable piece 162 comes into contact with the contact portion 167 of the fixed terminal 163 in conjunction with the on-manipulation of the manipulator 120, the movable piece 162 included in the first power switch mechanism 160 is turnably supported by a displacement support portion 169 that performs the sliding movement of the movable piece 162 in a direction substantially orthogonal to a direction in which the contact portions 166 and 167 are brought into contact and separated from each other.

In the displacement support portion 169, turning support pieces 169*a* that are vertically provided in parallel while the movable piece 162 is sandwiched therebetween, and the L-shaped movable piece 162 is turnably supported by the turning support pieces 169*a* such that a horizontal side of the movable piece 162 is sandwiched between the turning support pieces 169*a*. Both the sides by which the movable piece 162 is turnably supported are notched into a convex groove and notched slightly longer on the horizontal side, whereby the movable piece 162 is permitted to slide in a horizontal direction.

In the state in which the contact portions 166 and 167 are in contact with each other, the movable piece 162 is supported at an angle at which the leading end side of L-shaped horizontal piece of the movable piece 162 is inclined downward, thereby promoting the sliding movement of the movable piece 162. Therefore, in performing the on-manipulation of the manipulator 120, the sliding movement of the movable piece 162 is slightly performed in the horizontal direction as the movable piece 162 turns (see FIG. 12B).

At this point, the contact portion 166 of the movable piece 162 slides on the contact portion 167 of the fixed terminal 163 in a given length (see FIG. 12C). What is call a wiping operation is performed. A welding avoiding ability is always obtained between the contact portions by the wiping operation.

Figure 13A:
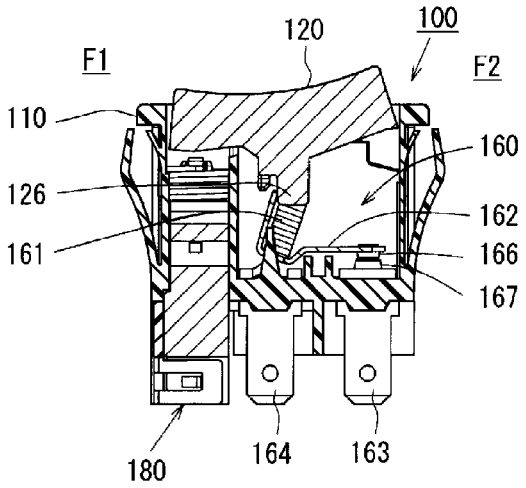
FIGS. 13A, 13B, and 13C are sectional explanatory views of the switch, illustrating welding separating operation of a contact portion.
Figure 13B:
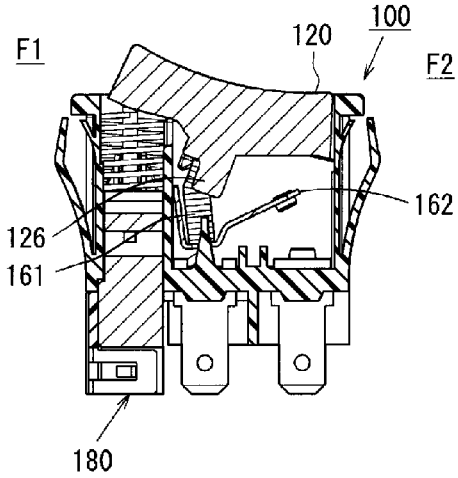
Figure 13C:
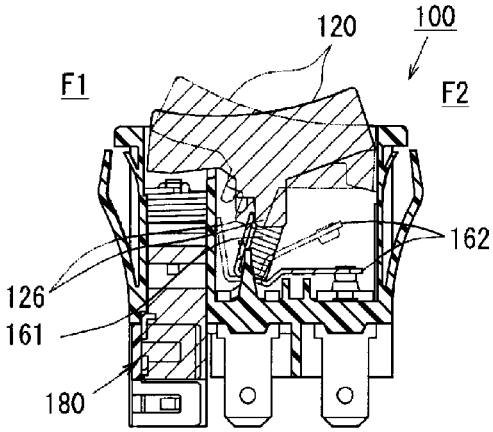

FIGS. 13A to 13C each illustrate an example of a welding avoiding operation of the first power switch mechanism 160. FIG. 13A is a vertical sectional view illustrating the switch 100 in the state in which the contact portions 166 and 167 are welded, FIG. 13B is a vertical sectional view illustrating the switch 100 in the state in which the welding is forcedly separated by the manipulator 120, and FIG. 13C is a vertical sectional view illustrating the switch 100 from the state in which the movable piece 162 is welded to the state in which the welding of the movable piece 162 is separated.

The manipulator 120 includes the forced pressurization piece 126. When the off-manipulation is performed to the manipulator 120, the forced pressurization piece 126 receives the manipulation force of the manipulator 120 to forcedly pressurize the movable piece 162 in the direction in which the contact portion 166 of the movable piece 162 is separated from the contact portion 167 of the fixed terminal 163.

In the forced pressurization piece 126, as illustrated in FIG. 13A, while the contact portions 166 and 167 are welded, when the manipulator 120 is manipulated in the off-direction, a turning resistance of the manipulator 120 is enhanced by the welding action of the contact portions 166 and 167 to regulate the smooth turning, whereby the off-operation is hardly performed.

In this case, when the manipulator 120 is further pressed in the off-manipulation direction, the forced pressurization piece 126 strongly presses the L-shaped vertical piece side of the movable piece 162 in the off-direction. Therefore, as illustrated in FIG. 13B, the contact portions 166 and 167 are forcedly separated from each other although the contact portions 166 and 167 are welded, which allows the power to be turned off.

As described above, the power reset unit in which the returning spring and the power reset mechanism are integrated is independently treated. Therefore, the power reset unit can simply be attached to the housing only by inserting the power reset unit from the bottom of the housing, and the assembling can efficiently be performed in a short time. Accordingly, switch assembling performance and the productivity of the switch are simultaneously improved. In detaching the power reset unit, the power reset unit is put into the state in which the power reset unit can be drawn from the stacked attachment portion, and the power reset unit is drawn directly downward from the bottom of the housing, which allows the power reset unit to be simply detached without needing a skill. After the switch is produced, the power reset unit can be exchanged without detaching the manipulator, and the switch can be changed to the desired voltage specification. Therefore, because the commoditizing of the switch is achieved, the switch is suitable to the market.

According to one or more embodiments of present invention, the housing body corresponds to the housing 110 before the power reset unit is attached, the power retaining and releasing mechanism corresponds to the power reset mechanism 150, power retaining and releasing mechanism portion corresponds to the power reset unit 180, the retaining portion corresponds to the permanent magnet 153 and the fixed magnetic piece 153*a*, the releasing portion corresponds to the solenoid 151, the positioning unit corresponds to retaining groove 155*h* and the retaining projection 112*a*, the spring guide unit corresponds to inner peripheral spring guide portion 155*f* and the outer peripheral spring guide portion 155*g*, and the connector guide corresponds to the connector coupling portion 155*m*, the connection space 155*n*, and the lower cover 156.

In one or more embodiments of the present invention, the retaining in the height direction and the positioning are performed by engaging the retaining groove 155*h* and the retaining projection 112*a* by way of example. Alternatively, the power reset unit 180 may be positioned such that an elastic member laterally biases and supports the power reset unit 180 at the position where the attachment of the power reset unit 180 is completed, or the power reset unit 180 may be positioned using a bonding agent or an adhesive tape.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for producing a switch, the switch including:

a manipulator that is supported by a housing and swung on one side and the other side;

a power switch mechanism that brings contact portions of a movable piece and a fixed terminal into contact with each other when the manipulator is swung onto one side, the movable piece and the fixed terminal being disposed opposite each other in the housing;

a returning spring that biases the manipulator in a swing manipulation direction when the manipulator is swung onto the other side; and a power retaining and releasing mechanism that includes a retaining portion and a releasing portion, the retaining portion regulating a restoring force of the returning spring according to the swing manipulation of the manipulator onto one side to retain a contact state of the contact portions of the movable piece and the fixed terminal, the releasing portion releasing the contact state retained by the retaining portion, wherein the method comprises:

configuring the switch to be dividable, treating one side of the divided switch as a housing body including a stacked attachment portion wherein the stacked attachment portion includes a shape that is identical to that of the power retaining and releasing mechanism portion, mounting the manipulator on the housing, attaching the returning spring and the power retaining and releasing mechanism on a lower side of the other side of the manipulator while stacked in the stacked attachment portion, treating the other side of the divided switch as a power retaining and releasing mechanism portion including the returning spring and the power retaining and releasing mechanism, which are attached to the stacked attachment portion of the housing body, and detachably attaching the power retaining and releasing mechanism portion from a bottom of the stacked attachment portion of the housing body, and wherein the housing in which the power retaining and releasing mechanism portion is incorporated includes the stacked attachment portion serving as an accommodation space for the power retaining and releasing mechanism portion on the one side.

2. The method for producing a switch according to claim 1, wherein the switch includes a slide case that is attached to and detached from the stacked attachment portion in a sliding manner, and wherein the power retaining and releasing mechanism portion is integrally incorporated in the slide case, and the slide case is attached to and detached from the stacked attachment portion by sliding the slide case to the stacked attachment portion.

3. The method for producing a switch according to claim 1, wherein the power retaining and releasing mechanism portion is directly attached and detached from the bottom of the stacked attachment portion of the housing body.

4. The method for producing a switch according to claim 1, wherein the power retaining and releasing mechanism portion is attached while a center position and a height position of the stacked attachment portion are positioned by a positioning unit.

5. The method for producing a switch according to claim 4, wherein the switch includes a slide case that is attached to and detached from the stacked attachment portion in a sliding manner, and wherein the power retaining and releasing mechanism portion is integrally incorporated in the slide case, and the slide case is attached to and detached from the stacked attachment portion by sliding the slide case to the stacked attachment portion.

6. A switch comprising:

a manipulator that is supported by a housing and swung on one side and the other side;

a power switch mechanism that brings contact portions of a movable piece and a fixed terminal into contact with each other when the manipulator is swung onto one side, the movable piece and the fixed terminal being disposed opposite each other in the housing;

a returning spring that biases the manipulator in a swing manipulation direction when the manipulator is swung onto the other side; and a power retaining and releasing mechanism that includes a retaining portion and a releasing portion, the retaining portion regulating a restoring force of the returning spring according to the swing manipulation of the manipulator onto one side to retain a contact state of the contact portions of the movable piece and the fixed terminal, the releasing portion releasing the contact state retained by the retaining portion, wherein the switch includes a housing body and a power retaining and releasing mechanism portion, the housing body including a stacked attachment portion, the manipulator being mounted on the housing and the returning spring and the power retaining and releasing mechanism being attached on a lower side of the other side of the manipulator while stacked in the stacked attachment portion wherein the stacked attachment portion includes a shape that is identical to that of the power retaining and releasing mechanism portion, wherein the power retaining and releasing mechanism portion including the returning spring and the power retaining and releasing mechanism, which are attached to the stacked attachment portion of the housing body so that the power retaining and releasing mechanism portion is detachably attached from a bottom of the stacked attachment portion of the housing body, and wherein the housing in which the power retaining and releasing mechanism portion is incorporated includes the stacked attachment portion serving as an accommodation space for the power retaining and releasing mechanism portion on the one side.

7. The switch according to claim 6, wherein the power retaining and releasing mechanism portion is directly attached and detached from the bottom of the stacked attachment portion of the housing body.

8. The switch according to claim 6, wherein the stacked attachment portion includes a positioning unit that attaches the power retaining and releasing mechanism portion to the stacked attachment portion while a center position and a height position are positioned.

9. The switch according to claim 8, wherein the power retaining and releasing mechanism portion is configured to be integrally incorporated in the slide case that attaches and detaches the returning spring and the power retaining and releasing mechanism to and from the stacked attachment portion in a sliding manner.

10. The switch according to claim 6, wherein the power retaining and releasing mechanism portion is configured to be integrally incorporated in a slide case that attaches and detaches the returning spring and the power retaining and releasing mechanism to and from the stacked attachment portion in a sliding manner.

11. The switch according to claim 10, further comprising a connector guide that is provided on a lower portion side of the slide case and connected to a terminal of the releasing portion.

12. The switch according to claim 10, further comprising a spring guide unit that is provided on an upper portion side of the slide case to guide the returning spring in a biasing direction.

13. The switch according to claim 12, further comprising a connector guide that is provided on a lower portion side of the slide case and connected to a terminal of the releasing portion.

* * * * *